US012270613B2

(12) United States Patent
Maquin et al.

(10) Patent No.: US 12,270,613 B2
(45) Date of Patent: Apr. 8, 2025

(54) HEAT EXCHANGER, HOUSING AND AIR CONDITIONING CIRCUIT COMPRISING SUCH AN EXCHANGER

(71) Applicant: Valeo Systemes Thermiques, Le Mesnil Saint-Denis (FR)

(72) Inventors: Olivier Maquin, Reims (FR); Jérôme Mougnier, Le Mesnil Saint-Denis (FR); Bruno Rose, Le Mesnil-Saint-Denis (FR)

(73) Assignee: VALEO SYSTEMES THERMIQUES, Le Mesnil-Saint-Denis (FR)

( * ) Notice: Subject to any disclaimer, the term of this patent is extended or adjusted under 35 U.S.C. 154(b) by 238 days.

(21) Appl. No.: 17/426,367

(22) PCT Filed: Jan. 22, 2020

(86) PCT No.: PCT/EP2020/051510
§ 371 (c)(1),
(2) Date: Jul. 28, 2021

(87) PCT Pub. No.: WO2020/156904
PCT Pub. Date: Aug. 6, 2020

(65) Prior Publication Data

US 2022/0099387 A1 Mar. 31, 2022

(30) Foreign Application Priority Data

Jan. 29, 2019 (EP) ..... 19154145

(51) Int. Cl.
*F28F 9/02* (2006.01)
*F28D 1/053* (2006.01)

(52) U.S. Cl.
CPC ..... *F28F 9/0263* (2013.01); *F28D 1/05391* (2013.01); *F28F 9/028* (2013.01); *F28F 2009/029* (2013.01)

(58) Field of Classification Search
CPC .... F28F 9/0263; F28F 9/028; F28F 2009/029; F28D 1/05391
See application file for complete search history.

(56) References Cited

U.S. PATENT DOCUMENTS

2006/0236718 A1* 10/2006 Lundberg ..... F28F 9/0217 62/515
2014/0224461 A1 8/2014 Bellenfant et al.
(Continued)

FOREIGN PATENT DOCUMENTS

DE 9400687 U1 5/1995
DE 102006018681 A1 10/2006
(Continued)

OTHER PUBLICATIONS

International Search Report and Written Opinion in corresponding International Application No. PCT/EP2020/051510, mailed Mar. 26, 2020 (8 pages).
(Continued)

*Primary Examiner* — Raheena R Malik
(74) *Attorney, Agent, or Firm* — Osha Bergman Watanabe & Burton LLP

(57) ABSTRACT

Heat exchanger, housing and air conditioning circuit comprising such an exchanger A heat exchanger comprising: a plurality of tubes (2), arranged in a first and a second row (3A, 3B), and through which a refrigerant is intended to circulate; a first and a second header tank (4, 5) inside which tanks the tubes (2) of each of the said rows emerge; the first header tank (4) comprising a refrigerant inlet compartment (17) into which the tubes of the first row (3A) emerge and a refrigerant outlet compartment (18) into which the tubes of the second row (3B) emerge, the second header tank (5) comprising at least one return compartment (28) into which at least one tube of the first row (3A) and one tube of the
(Continued)

second row (3B) emerge, wherein the outlet compartment (18) has a smaller volume than the inlet compartment (17).

13 Claims, 4 Drawing Sheets

(56) References Cited

U.S. PATENT DOCUMENTS

| | | | | |
|---|---|---|---|---|
| 2018/0100706 | A1* | 4/2018 | Taras | F28D 9/0093 |
| 2020/0166253 | A1* | 5/2020 | Higashiiue | F28F 9/0263 |
| 2021/0071966 | A1* | 3/2021 | Maquin | F28F 9/0224 |
| 2022/0099387 | A1* | 3/2022 | Maquin | F28D 1/05341 |

FOREIGN PATENT DOCUMENTS

| | | | |
|---|---|---|---|
| DE | 102013208396 | A1 | 11/2014 |
| EP | 1798506 | A2 | 6/2007 |
| JP | 2008-8584 | A | 1/2008 |
| KR | 20060009653 | A * | 1/2006 |

OTHER PUBLICATIONS

The First Office Action issued in Chinese Application No. 202080011095.0, dated Aug. 31, 2022 (8 pages).

* cited by examiner

HEAT EXCHANGER, HOUSING AND AIR CONDITIONING CIRCUIT COMPRISING SUCH AN EXCHANGER

FIELD OF THE INVENTION

The present invention relates to a heat exchanger, for example used as a condenser in a heating, ventilation and/or air conditioning installation for a motor vehicle interior. The invention also relates to a heating, ventilation and/or air conditioning installation housing and to an air conditioning circuit comprising such a heat exchanger.

BACKGROUND OF THE INVENTION

Heat exchangers are subject to ever increasing requirements relating to performance, while at the same time the size is required to be kept at the same level or reduced. The same criteria applies to manufacturing costs. In case of heat exchangers with refrigerant travelling in tubes between manifolds, where the heat exchange is supposed to take place with air crossing the heat exchanger in-between said tubes arranged in rows, another requirement may relate to thermal imbalance. For example, the heat exchange area of the heat exchanger, defined by the tube rows, may be divided into multiple measurements sections parallel to those rows. The thermal performance may be required to be kept at the same or very similar level for all these sections. Such performance is often related to refrigerant flow rate within individual tubes. If the flow rate amongst the tubes in non-homogenous, an unacceptable thermal imbalance may occur, i.e. the air leaving the heat exchanger after travelling in-between the tubes may have temperature values which differ too greatly throughout measurement sections.

The present invention aims to provide a heat exchanger in which thermal imbalance is reduced, without unfavorably affecting the manufacturing costs and the external dimensions.

SUMMARY OF THE INVENTION

The object of the invention is, among others, a heat exchanger comprising: a plurality of tubes, arranged in a first and a second row, and through which a refrigerant is intended to circulate; a first and a second header tank inside which tanks the tubes of each of the said rows emerge; the first header tank comprising a refrigerant inlet compartment into which the tubes of the first row emerge and a refrigerant outlet compartment into which the tubes of the second row emerge, the second header tank comprising at least one return compartment into which at least one tube of the first row and one tube of the second row emerge, wherein the outlet compartment has a smaller volume than the inlet compartment.

Preferably, the same amount of tubes emerges into the inlet compartment and the outlet compartment.

Preferably, for at least part of the tubes of the second row, the outlet compartment comprises a limiting arrangement decreasing its local cross-section with respect to corresponding cross-section for the tubes of the first row in the inlet compartment.

Preferably, the limiting arrangement is adapted to decrease the cross-section of the outlet compartment for all the tubes of the second row.

Preferably, the limiting arrangement is a reduced distance between the tubes and the wall of the outlet compartment facing the tubes, when compared with the respective distance for the inlet compartment.

Preferably, the limiting arrangement is an insert abutting the inner side of outlet compartment.

Preferably, the insert has a crescent-shaped cross-section.

Preferably, the volume of the outlet compartment is reduced by 40-60% with respect to the volume of the inlet compartment.

Preferably, the volume of the outlet compartment is reduced by 50% with respect to the volume of the inlet compartment.

Preferably, the heat exchanger is a two-pass heat exchanger.

Another object of the invention is a heating, ventilation and/or air conditioning installation housing comprising the heat exchanger as described.

Another object of the invention is an air conditioning circuit comprising such a heat exchanger comprising the heat exchanger as described.

BRIEF DESCRIPTION OF DRAWINGS

Examples of the invention will be apparent from and described in detail with reference to the accompanying drawings, in which.

DETAILED DESCRIPTION OF EMBODIMENTS

Figure 1:
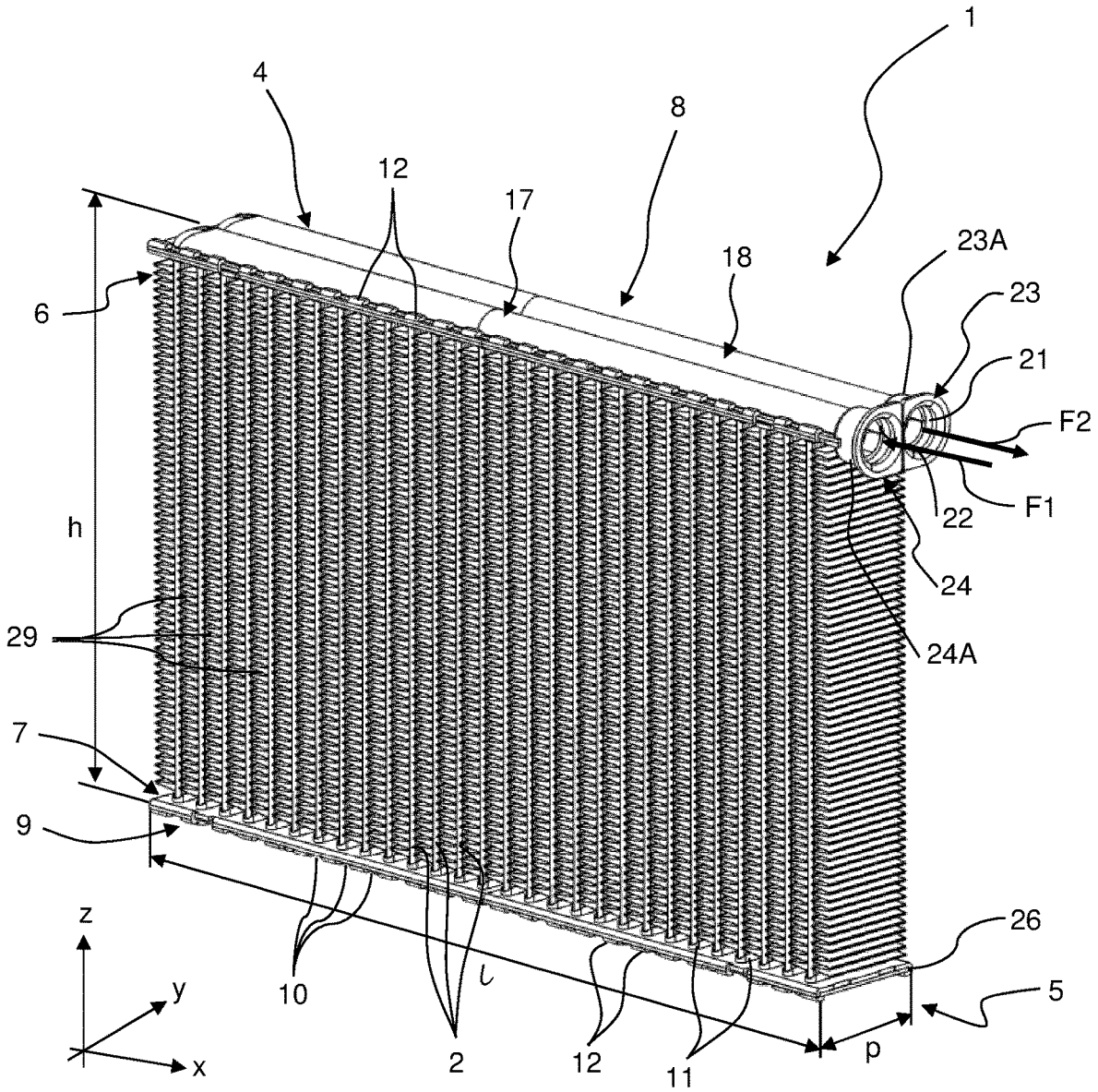
FIG. 1 depicts, in a schematic perspective view, one exemplary embodiment of a heat exchanger according to the present invention, once it has been assembled.
Figure 2:
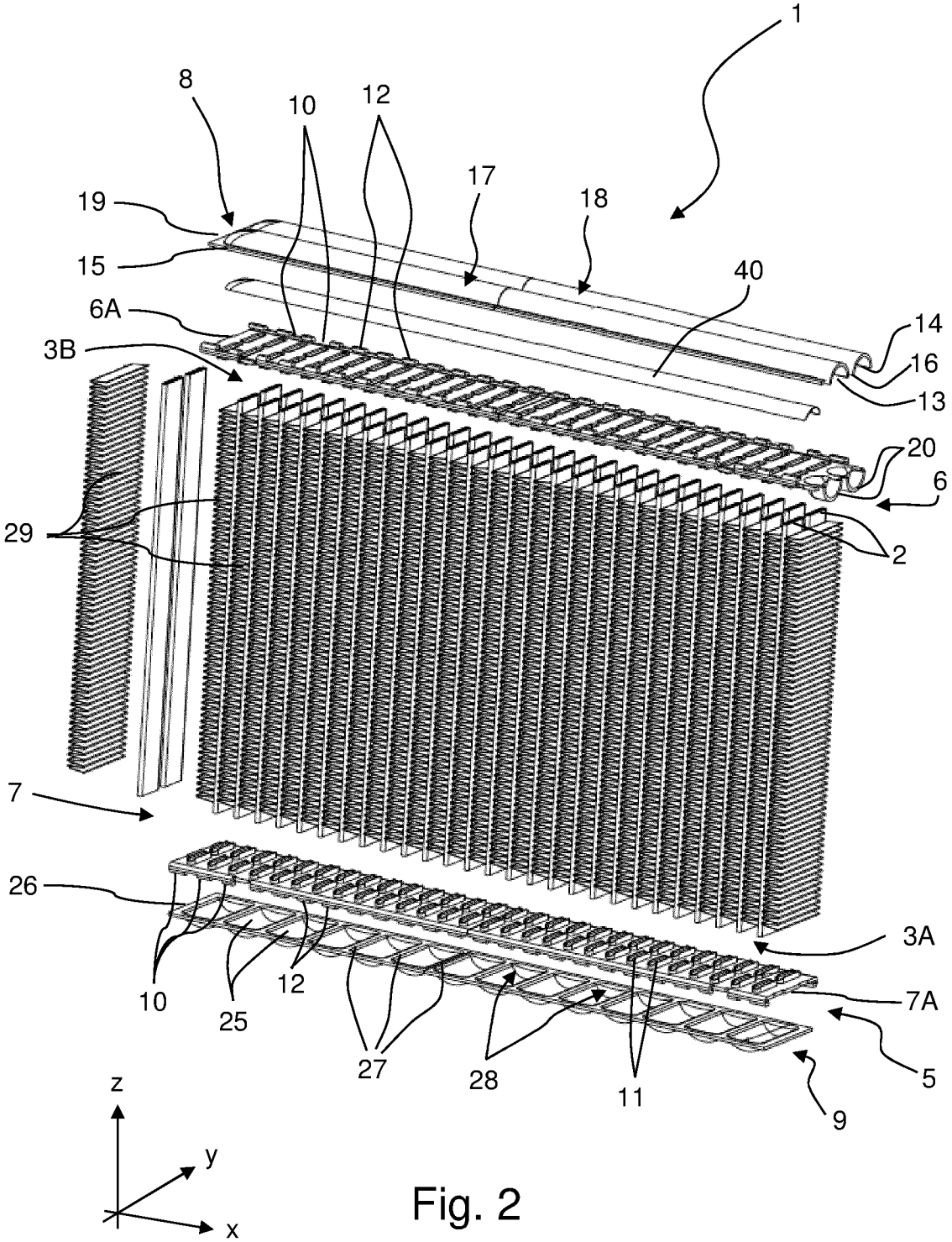
FIG. 2 schematically illustrates, in an exploded perspective view, the heat exchanger of FIG. 1.

FIGS. 1 and 2 depict one exemplary embodiment of a heat exchanger 1 according to the present invention. In one particular application of the present invention, the heat exchanger 1 is an inner condenser incorporated into a motor vehicle air conditioning circuit (not depicted in the figures) operating at least in a heat pump mode, the inner condenser being placed inside a housing of the heating, ventilation and/or air conditioning installation of the vehicle (none of which have been depicted).

It will be noted that, as an alternative, such a heat exchanger could also be used as a vehicle front end heat exchanger, provided that modifications relating notably to the dimensions of the structure of the exchanger are made.

As these figures show, the heat exchanger 1, which extends over a width l in a longitudinal direction x, over a depth p in a transverse direction y perpendicular to the longitudinal direction x, and over a height h in a vertical direction z perpendicular to the longitudinal direction x and to the transverse direction y, comprises a core bundle of tubes which is formed of a plurality of longitudinal tubes 2, extending in the vertical direction z, through which a refrigerant from the air conditioning circuit can pass.

It should be noted that the tubes 2 could alternatively be arranged horizontally or even at any angle of inclination, the vertical direction being the preferred direction for the interior exchanger mounted inside the housing of the vehicle ventilation installation. The vertical or horizontal direction of an element, particularly the tubes, is determined with reference to the position that the exchanger may adopt once it has been installed in the vehicle, it being possible for such a position to be assessed without necessarily placing the exchanger in the vehicle.

The tubes 2 are distributed among a first row 3A and a second row 3B which are parallel to one another and arranged one behind the other in the transverse direction y. Thus, each row of tubes 3A, 3B comprises a plurality of tubes 2 which are evenly distributed in the longitudinal direction x. The tubes 2 are all of the same length. Preferably, all tubes 2 in both rows 3A, 3B are identical.

The heat exchanger 1 also comprises a first and a second header tank 4 and 5, of a shape that is elongate in the longitudinal direction x, inside which the tubes 2 of each of the said rows 3A and 3B emerge. The two longitudinal ends of the tubes 2 are therefore housed respectively in the first header tank 4 and in the second header tank 5.

The first and second header tanks 4 and 5 each comprise a bottom plate 6, 7 and a cover 8, 9 attached to the latter.

The bottom plate 6, 7 and the cover 8, 9 of each of the header tanks 4, 5 have a rectangular shape and extend lengthwise in the longitudinal direction x and widthwise in the transverse direction y.

Each bottom plate 6, 7, made of a metallic material, comprises a flat contact face 6A, 7A, against which the corresponding cover 8, 9 is mounted, which face is pierced with a plurality of through-orifices 10 distributed in a first and a second row that are parallel and extend in the longitudinal direction x.

The cross section of the orifices 10 corresponds to the external cross section of the tubes 2 so that the longitudinal end of each of the tubes 2 can, at least in part, pass through the corresponding orifice 10 in the bottom plate 6, 7.

Furthermore, the contour of each of the orifices 10 in the bottom plates 6 and 7 is surmounted by an external collar 11, the internal cross section of which is more or less identical to that of the orifice 10 it extends so that the corresponding tube 2 can be attached securely. Each collar 11 extends, in the vertical direction z, outside the corresponding header tank 4, 5.

In addition, each bottom plate 6, 7 comprises a plurality of attachment tabs 12, uniformly distributed along its lateral edges, which are folded over onto the lateral edges of the corresponding cover 8, 9.

Moreover, the cover 8 of the first header tank 4 has a first and a second longitudinal recess 13 and 14, otherwise known as a longitudinal deformation, which are parallel to one another and extend in the longitudinal direction x. In this example, the two adjacent recesses 13 and 14 may have a cross section of semicircular shape.

The longitudinal recesses 13 and 14 may be produced by pressing a metal plate 15 which, once pressed, forms the cover 8 of the first header tank 4.

The first longitudinal recess 13 is separated from the second longitudinal recess 14 by a longitudinal dividing partition 16 extending in the direction x. In particular, this longitudinal partition 16 is formed by a portion of the metal plate 15 that is kept in sealed contact with the corresponding bottom plate, for example by brazing. In other words, the longitudinal dividing partition 16 corresponds to a non-pressed longitudinal portion of the metal plate 15 that forms the cover 8.

Thus, when the cover 8 of the first header tank 4 is secured to the corresponding bottom plate 6, the first and second longitudinal recesses 13 and 14 respectively define a refrigerant inlet compartment 17 into which the tubes 2 of the first row 3A emerge, and a refrigerant outlet compartment 18, adjacent to the inlet compartment 17, into which the tubes 2 of the second row 3B emerge. In other words, the orifices 10 of the first row of the bottom plate 6 open into the inlet compartment 17, while those of the second row open into the outlet compartment 18.

One of the longitudinal ends of the first and second recesses 13 and 14 is open and opens into one of the longitudinal ends of the cover 8, the opposite longitudinal end being closed by a transverse partition 19 formed by a non-pressed portion of the metal plate 15 in sealed contact with the bottom plate 6.

Moreover, the bottom plate 6 of the first header tank 4 comprises two gutters, otherwise known as semicircular deformations 20, arranged respectively facing the longitudinal ends of the inlet 17 and outlet 18 compartments. Each of the semicircular deformations 20, produced for example by pressing the bottom plate 6, runs longitudinally over a reduced portion of this plate and has a cross section of semicircular shape, the internal diameter of which is identical to that of the longitudinal recesses 13 and 14.

Thus, when the bottom plate 6 and the cover 8 of the first header tank 4 are assembled together, the longitudinal recesses 13 and 14 find themselves respectively facing the semicircular deformations 20 so as to delimit a refrigerant inlet 21 or outlet 22 duct with circular internal and external cross sections.

Furthermore, the heat exchanger 1 comprises a refrigerant inlet nozzle 23 and a refrigerant outlet nozzle 24 which are respectively in fluidic communication with the inlet compartment 17 and the outlet compartment 18 so as to allow the heat exchanger 1 to be connected up to the refrigerant circuit. The inlet 23 and outlet 24 nozzles each comprise a lateral skirt 23A, 24A attached to an exterior face of the inlet 21 and outlet 22 ducts of the first header tank 4, at one of the longitudinal ends thereof. It will thus be appreciated that the lateral skirt 23A, 23B has an internal diameter equal to the external diameter of the assembly formed by the longitudinal recess 13, 14 pressed against or up close to the relevant semicircular deformation 20.

Moreover, the cover 9 of the second header tank 5 has a plurality of identical transverse recesses 25 parallel to one another and which run in the transverse direction y. The transverse recesses 25 have a cross section of substantially semicircular shape. They can be achieved by pressing a metal plate 26 which, once pressed, forms the cover 9 of the second header box 5.

Furthermore, the transverse recesses 25 are separated from one another by transverse dividing partitions 27 extending in the direction y. In particular, each transverse partition 27 is formed by a portion of the metal plate 26 kept in sealed contact with the corresponding bottom plate 7. In other words, the transverse dividing partitions 27 each correspond to an unpressed longitudinal portion of the metal plate 26 that forms the cover 9.

Once the cover 9 of the second header box 5 has been fixed to the associated bottom plate 7, the transverse recesses 25 define refrigerant return compartments 28 into which two tubes 2 of the first row 3A and two tubes 2 of the second row 3B emerge. It goes without saying that the number of tubes 2 of the first row 3A and of the second row 3B that emerge into each return compartment 28 may be less than or greater than two.

Each return compartment 28 has no fluidic communication with the adjacent return compartment or compartments 28.

Thus, each return compartment 28 places two tubes 2 of the first row 3A in fluidic communication with the two tubes 2 opposite them belonging to the second row 3B. The cross section of the return compartments 28 is advantageously determined so that the pressure drops suffered by the fluid passing through the heat exchanger 1 are minimized.

Moreover, the heat exchanger 1 also comprises corrugated separators 29 formed of a plurality of heat exchanger fins. Each corrugated separator 29 is intercalated between two adjacent tubes 2 of the first row 3A and extends between the two adjacent tubes 2 opposite belonging to the second row 3B. Brazed contact is maintained between the corrugated separator 29 and the corresponding tubes 2 which flank it in order to facilitate heat exchange.

As an exception, the separators 29 intercalated at the ends of the core bundle of tubes 2 may be in contact with just one tube 2 of the first row 3A and of the second row 3B and with an end plate that provides the structure of the heat exchanger 1 with greater stiffness.

By virtue of the invention, the refrigerant circulating through the heat exchanger 1 is distributed uniformly through the tubes 2 of the first row 3A by the inlet compartment 17 having been introduced into this compartment by the inlet nozzle 23, as depicted symbolically by the arrow F1.

Once it has finished passing through the tubes 2 of the first row 3A, the refrigerant is guided into the tubes 2 of the second row 3B by the corresponding return compartments 28.

The refrigerant then passes through the tubes 2 of the second row 3B to arrive in the outlet compartment 18 via which it is finally discharged out of the heat exchanger 1 having passed through the outlet nozzle 24 as the arrow F2 illustrates.

In other words, according to the invention, the circulation of refrigerant through the heat exchanger 1 is a two-pass circulation, the first pass corresponding to the passage through the first row of tubes 3A, the second pass corresponding to the passage through the second row 3B. In this way, internal pressure drops are limited notably by comparison with a four-pass heat exchanger, while uniformity of temperature across the front face of the exchanger is maintained making the exchanger compatible with and useable in a setup in a housing of a vehicle ventilation installation.

Advantageously, the heat exchanger 1 comprises fixing means (not depicted in the figures) which, once the heat exchanger is installed in a housing of a heating, ventilation and/or air conditioning installation, allow its tubes to be kept vertical.

Figure 3:
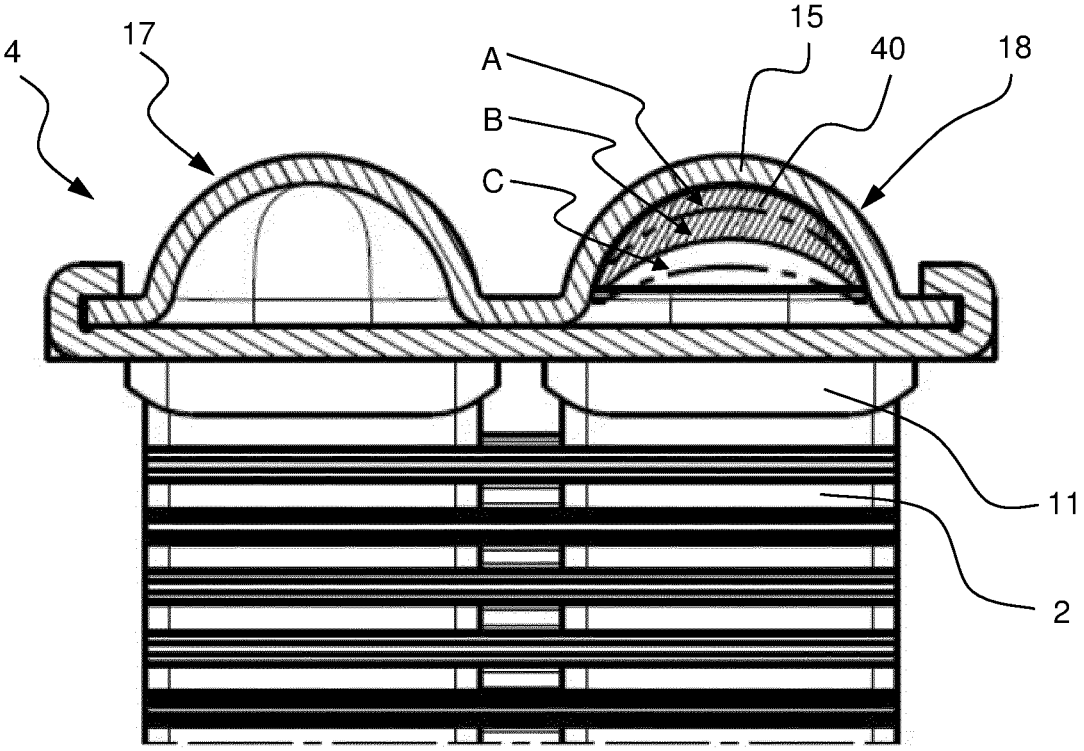
FIG. 3 is a partial cross-section of the inlet and outlet compartments of the heat exchanger of FIGS. 1 and 2.

As can be seen in FIG. 2 and FIG. 3, the outlet compartment 18 comprises a limiting arrangement decreasing its local cross-section with respect to corresponding cross-section for the tubes 2 of the first row 3A in the inlet compartment 17. As a direct result, the outlet compartment 18 has a smaller volume than the inlet compartment 17. When the same amount of tubes 2 emerges into the inlet compartment 17 and the outlet compartment 18, the efficiency of refrigerant distribution is improved, as will be explained further. In the example shown in FIGS. 2 and 3, the limiting arrangement is an insert 40 abutting the inner side of outlet compartment 18. Preferably, the insert 40 has a crescent-shaped cross-section. It follows at least a part of the inner contour of the outlet compartment 18 along axis X. In this case, the insert 40 has a length substantially equal to the length of the outlet compartment 18.

FIG. 3 shows a partial cross-section of the inlet and outlet compartments 17, 18 of the heat exchanger of FIGS. 1 and 2. The insert 40 follows closely (abuts) the inner wall of the outlet compartment 18. The presence of the limiting arrangement effectively decreases the cross-section of the outlet compartments 18 available for the flow of the refrigerant. Three exemplary shapes are presented. In variant A, the cross-section area is reduced by 40%. In variant B, the cross-section area is reduced by 50%. In variant C, the cross-section is reduced by 60% area. The advantage of applying an insert 40 as the limiting arrangement is that the cross-section/volume reduction can be easily adapted to the needs of the heat exchanger or the system. This may concern the constant reduction along the axis X or regional, local adaptation for specific tube groups. It will be appreciated that any foreseen reduction always envisages the possibility of refrigerant flow within the outlet compartment 18 from one its end to the other, i.e. the reduction is never 100% of the cross-section area.

Figure 4:
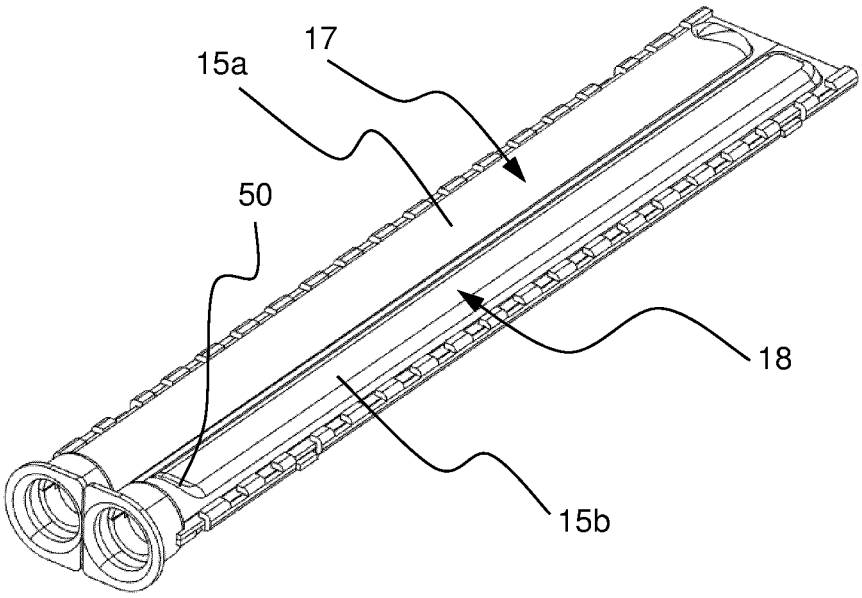
FIG. 4 is a perspective view of a variant of the first header tank.
Figure 5:
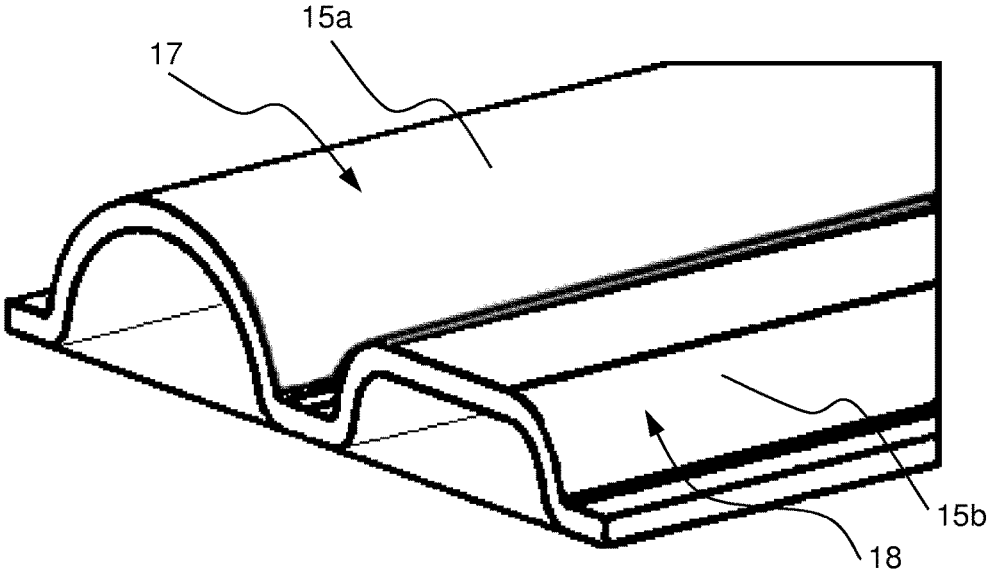
FIG. 5 is a closer view of the first header tank shapes of FIG. 4.

FIG. 4 is a perspective view of a variant of the first header tank 4. The limiting arrangement here is applied in form of a reduced distance between the tubes 2 and the wall of the outlet compartment 18 facing the tubes 2, when compared with the respective distance for the inlet compartment 17. In other words, the cover 8 of the first header tank 4 is shaped so that the outlet compartment 18 has a smaller height than the inlet compartment 17. The lower outlet compartment 18 effectively has a reduced cross-section area, which translates to reduced volume for the refrigerant in the outlet compartment 18. In the shown example, the metal plate 15 is shaped differently for the inlet compartment 17 and the outlet compartment 18. The metal plate 15 comprises two portions—an inlet portion 15*a* and an outlet portion 15*b*, which respectively form the inlet compartment 17 and the outlet compartment 18. The outlet portion 15*b* is effectively flattened when compared to the inlet portion 15*a*. The inlet portion 15*a* retains its semi-circular shape, while the outlet portion 15*b* assumes a trapezoidal-shape. The advantage of providing the limiting arrangement by affecting the shape of the plate forming the cover is that the heat exchanger manufacturing is simplified while remaining cost effective.

In this variant, the outlet compartment comprises a sloped section 50 which enables cooperation between the outlet nozzle 24 and the lateral skirt 24 as shown in FIGS. 1 and 2.

Figure 6:
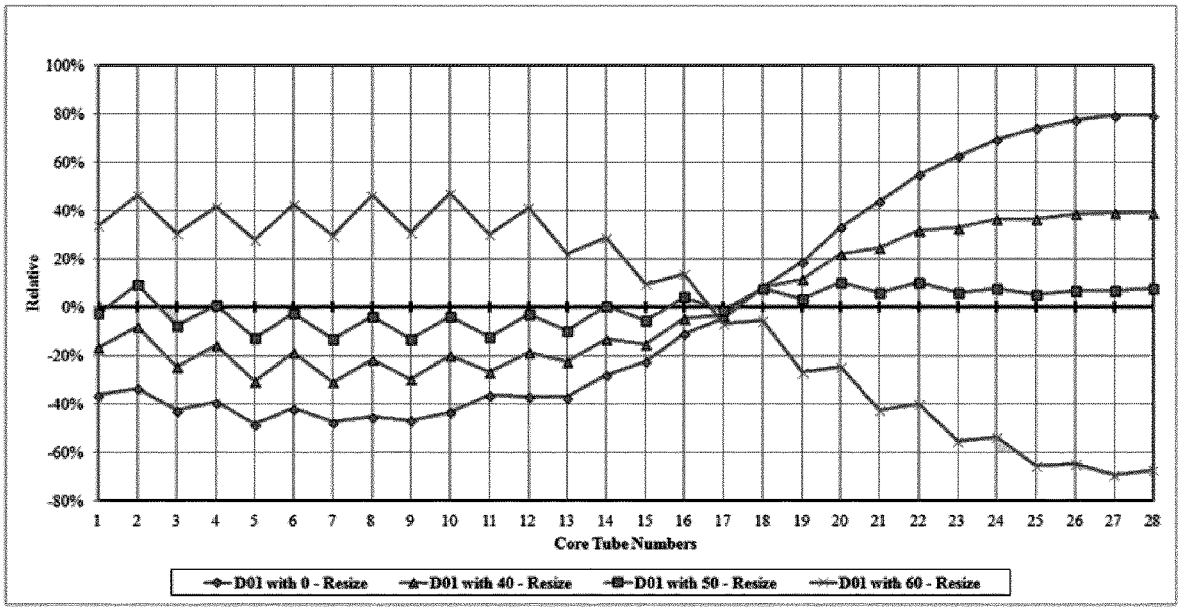
FIG. 6 is a graph presenting the relative percentage refrigerant flow rate in each tube for selected compartment dimensioning values.

FIG. 6 is a graph presenting the relative percentage refrigerant flow rate in each tube for selected compartment dimensioning values. In greater detail, the horizontal X axis shows the number of tubes from 1 to 28. On the vertical Y axis there is shown the relative percentage refrigerant flow rate in each tube. The ideal case is to have 0% for all tubes, which means that each tube is characterized by the same refrigerant flow rate. The graph is a result of a CFD simulation, where some assumptions had to be made due to di-phasic flow of the refrigerant. Four curves were simulated, the reference one (D01 with 0—Resize) representing the original tank with identical volumes for the inlet and outlet compartments. The other curves are the result for outlet compartment resizing with –X % of reduction on cross-section area. Consequently, there are curves for 40% reduction, 50% reduction and 60% reduction of the cross-section area of the outlet compartment. In this case, the reduction pertains to substantially whole length of the outlet compartment 18. The conclusion from simulation is that reduction at the level of 50% is optimal, as the flow rate is fairly balanced for all the tubes. It will be appreciated that in the shown examples, as the cross-section of the outlet compartment 18 remains substantially constant along its whole length, the cross-section area reduction affects the volume for the refrigerant to the same degree. The end section and front cross-section variations are kept to minimum and do not influence substantially the performance.

In view of above, the volume of the outlet compartment 18 is preferably reduced by 40-60% with respect to the volume of the inlet compartment 17.

In one variant, the volume of the outlet compartment 18 is reduced by 50% with respect to the volume of the inlet compartment 17.

Other variations to the disclosed embodiments can be understood and effected by those skilled in the art in practicing the claimed invention, from a study of drawings, the disclosure, and the appended claims. The mere fact that certain measures are recited in mutually different dependent claims does not indicate that a combination of these measures cannot be used to the advantage.

The invention claimed is:

1. A heat exchanger comprising:

a plurality of tubes arranged in a first and a second row and through which a refrigerant is intended to circulate;

a first and a second header tank inside which the plurality of tubes of each of the said rows emerge;

the first header tank comprising a refrigerant inlet compartment into which the tubes of the first row emerge and a refrigerant outlet compartment into which the tubes of the second row emerge, the second header tank comprising at least one return compartment into which at least one tube of the first row and one tube of the second row emerge, and the first header tank comprising a cover having an inlet portion and an outlet portion, the inlet portion having a semi-circular shape and the outlet portion having a flattened shape compared to the inlet portion, such that a height of the inlet portion is greater than a height of the outlet portion, wherein the outlet compartment has a smaller volume than the inlet compartment.

2. The heat exchanger according to claim 1, wherein the same amount of tubes emerges into the inlet compartment and the outlet compartment.

3. The heat exchanger according to claim 1, wherein for at least part of the tubes of the second row, the cover is formed such that a local cross-section of the outlet compartment is decreased with respect to a corresponding cross-section for the tubes of the first row in the inlet compartment.

4. The heat exchanger according to claim 3, wherein the shape of the outlet portion of the cover is adapted to decrease a cross-section of the outlet compartment for all the tubes of the second row.

5. The heat exchanger according to claim 3, wherein the cover is formed such that a distance between the tubes and a wall of the outlet compartment facing the tubes is reduced, when compared with a respective distance for the inlet compartment.

6. The heat exchanger according to claim 1, wherein the volume of the outlet compartment is reduced by 40-60% with respect to the volume of the inlet compartment.

7. The heat exchanger according to claim 1, wherein the volume of the outlet compartment is reduced by 50% with respect to the volume of the inlet compartment.

8. The heat exchanger according to claim 7, wherein the heat exchanger is a two-pass heat exchanger.

9. The heat exchanger according to claim 1, wherein the outlet portion is trapezoidal-shaped.

10. The heat exchanger according to claim 1, further comprising a refrigerant inlet nozzle and a refrigerant outlet nozzle in fluidic communication with the inlet compartment and the outlet compartment, respectively, wherein each of the nozzles comprises a lateral skirt attached to the first header tank.

11. The heat exchanger according to claim 1, wherein the cover is formed from a pressed metal plate.

12. A heating, ventilation and/or air conditioning installation housing comprising a heat exchanger comprising:

a plurality of tubes arranged in a first and a second row and through which a refrigerant is configured to circulate;

a first and a second header tank inside which the plurality of tubes of each of the said rows emerge;

the first header tank comprising a refrigerant inlet compartment into which the tubes of the first row emerge and a refrigerant outlet compartment into which the tubes of the second row emerge, the second header tank comprising at least one return compartment into which at least one tube of the first row and one tube of the second row emerge; and the first header tank comprising a cover having an inlet portion and an outlet portion, the inlet portion having a semi-circular shape and the outlet portion having a flattened shape compared to the inlet portion, such that a height of the inlet portion is greater than a height of the outlet portion, wherein the outlet compartment has a smaller volume than the inlet compartment.

13. An air conditioning circuit comprising the heat exchanger according to claim 1.

* * * * *